United States Patent [19]

Piggott

[11] Patent Number: 4,618,101

[45] Date of Patent: Oct. 21, 1986

[54] SPRAY NOZZLE

[76] Inventor: Richard G. Piggott, 936 Marshall Ave., Bellwood, Cook County, Ill. 60104

[21] Appl. No.: 554,779

[22] Filed: Nov. 25, 1983

[51] Int. Cl.[4] ..... B05B 1/02

[52] U.S. Cl. ..... 239/589; 239/599; 239/602

[58] Field of Search ..... 239/599, 589, 602

[56] References Cited

U.S. PATENT DOCUMENTS

| | | | |
|---|---|---|---|
| 3,858,812 | 1/1975 | Williams et al. | 239/599 |
| 4,103,830 | 8/1978 | Roth | 239/599 X |
| 4,200,232 | 4/1980 | Fraley et al. | 239/290 X |
| 4,258,885 | 3/1981 | Legeza | 239/599 X |
| 4,432,497 | 2/1984 | Wöste | 239/589 |

FOREIGN PATENT DOCUMENTS

| | | | |
|---|---|---|---|
| 831426 | 1/1970 | Canada | 239/600 |
| 451729 | 8/1936 | United Kingdom | 239/601 |

*Primary Examiner*—Joseph F. Peters, Jr.
*Assistant Examiner*—Daniel R. Edelbrock
*Attorney, Agent, or Firm*—James T. FitzGibbon; Angelo J. Bufalino

[57] ABSTRACT

A spray nozzle for use in an airless spray gun wherein the surface finish of the spray nozzle tip is highly polished to create a mirror-like or micro-finish, in the immediate area surrounding the exit orifice of the spray nozzle tip, such that during the use of the spray nozzle, the material sprayed therethrough will not substantially build up or collect on the spray nozzle tip in such a degree that would necessitate the removal for cleaning of the tip, thereby significantly enhancing the performance and operation of the spray nozzle in connection with its spraying operations.

6 Claims, 4 Drawing Figures

SPRAY NOZZLE

BACKGROUND OF THE INVENTION

This invention relates in general to spray nozzle assemblies for airless spray guns, or the like, and is more particularly concerned with improvements in the spray nozzle tip, in an effort to substantially reduce or eliminate the build up of residue material in the area surrounding the orifice exit of the spray nozzle tip, in order to enhance the performance and operation of the spray nozzle.

Typically, a spray nozzle is mounted in a spray head of an airless spray gun. It is well known that such spray guns are used to apply liquid products, such as resinous coatings, to a variety of surfaces, including metal surfaces. The liquid product which is applied passes through a specially designed opening or orifice in the spray nozzle tip. The opening is designed so that a specific spray pattern or spray distribution can be applied to the product to be sprayed.

During the operation of the spray gun at pressures of 250 pounds per square inch (PSI) or higher, very fine droplets of the sprayed material will float in atmosphere around the object being sprayed. Due to the high velocity of the spray material exiting the spray nozzle tip, the air containing these droplets is pulled across the spray nozzle tip. The collection of these fluid particles or droplets on the nozzle spray tip and the resultant drying of such droplets on the spray nozzle tip can seriously hamper the performance of the spray nozzle by interferring with the spray pattern or spray distribution having exited the spray nozzle orifice. It is extremely important to keep the spray nozzle tip clean to prevent the build-up of material from affecting the distribution of the spray leaving the nozzle orifice. The improper distribution will result in an improper coating of the object being sprayed.

The problem of collection or build-up of material or particles on the spray nozzle tip is multipled when the product being sprayed is positioned very close to the spray nozzle tip. As the sprayed material bounces off the sprayed object, additional material or particles will permeate the air surrounding the nozzle spray tip resulting in collection of additional material on the tip. Further, increasing the pressure under which the material is sprayed results in a greater velocity of the sprayed material, thereby causing the formation of additional droplets, which are also present in the atmosphere surrounding the tip.

Spray nozzles are generally made of metal, such as carbide, and the surface of any metal object, when magnified sufficiently, exhibits asperities on such surface. The presence of these asperities combined with the very fine droplets in atmosphere surrounding the spray nozzle tip during use, results in the mechanical interlocking of such droplets with such asperities, thereby allowing a collection of material on the spray nozzle tip, which has been heretofore described as being undesirable. As a result of this collection, frequent cleaning and removal of the spray nozzle tip is required to maintain optimum performance.

A specfic example of the use of a spray nozzle and spray gun would be in the lacquering or coating of the inside of cans, prior to filling the can with a food, beverage or like substance. In this application, it is very important to maintain the proper distribution of the spray that is to be applied to the inside of the can. Improper applications of the sprayed material will result in rust or corrosion in the areas inside the cans which are not properly covered with the sprayed material.

An improper coating application can be caused by the collection of the residue of the sprayed material around the orifice of the spray nozzle tip. Such collection or buildup continues until it makes contact with the spray exiting the orifice and thereby adversely alters the spray pattern having exited the spray nozzle.

Furthermore, in the case of lacquering or coating the inside of the can, which process is completely automated, when a nozzle is not spraying the proper distribution or pattern the entire process must be stopped to permit cleaning and/or removal of the spray nozzle. This results in significant downtime of the machine, which condition is also undesirable.

As previously pointed out, the collection of material on the spray nozzle tip also adversely affects the spray pattern having exited the spray nozzle which can result in a sprayed product being rejected as unacceptable, due to an unacceptable or improper spray coating.

Heretofore, attempts have been made to solve these aforementioned problems. As disclosed in my U.S. Pat. No. 4,256,260, there is shown a spray head into which a spray nozzle is mounted, which mounting facilitates the easy cleaning or replacement of the spray nozzle. While this handles pluggage or partial blockage which occurs internally within the nozzle, this solution still requires the shutdown of the entire operation to effect such removal and cleaning.

It would be very desirable to have a spray nozzle, which, because of its own properties, will prevent the adherence and resultant collection of material on the spray nozzle tip, such that frequent cleaning and replacement is not necessary.

SUMMARY OF INVENTION

It is therefore, a general object of the present invention to improve spray nozzles in an attempt to substantially reduce or eliminate the collection of the sprayed material on the spray nozzle.

A more specific object of the present invention is to enhance the performance of spray nozzles and spray guns by substantially reducing or eliminating the build-up of the sprayed material on the spray nozzle tip, which buildup can adversely affect the distribution or spray pattern of the nozzle.

Another object of this invention is to provide a spray nozzle, which by its own properties, substantially reduces or eliminates the build-up or collection on the spray nozzle tip.

It is another object of the invention to provide a spray nozzle which has a surface finish thereon sufficient to substantially reduce or prevent the build-up of material on the spray nozzle tip thereby reducing the risk of damage to and enhancing the performance of the spray nozzle tip.

Still another object of the invention is to polish spray nozzle tips sufficiently to obtain a mirror-like or micro-finish to substantially reduce or prevent the sprayed material from adhering to the spray nozzle thereby reducing or eliminating the build-up or collection of material on the spray nozzle tip.

A further object of this invention is to prevent or substantially reduce the affixation of fluid droplets on the spray nozzle tip.

It is another object of this invention to reduce or eliminate the need for frequent cleaning and/or removal of spray nozzles from spray guns.

To this end the invention which is disclosed and claimed herein comprises a spray nozzle for use in an airless spray gun wherein the surface finish of the spray nozzle tip is highly polished to create a mirror-like or microfinish, in the immediate area surrounding the exit orifice of the spray nozzle tip, such that during the use of the spray nozzle, the material sprayed therethrough will be substantially prevented from building up or collecting on the spray nozzle tip in such a degree that would necessitate the removal for cleaning of the tip, thereby significantly enhancing the performance and operation of the spray nozzle in connection with its spraying operations.

DESCRIPTION OF THE DRAWINGS

The aforesaid objects and other objects and advantage of the invention will become more apparent when reference is made to the accompanying detailed description of the preferred embodiment of the invetion which is set forth herein, by way of example, and shown in the accompanying drawings, wherein like reference numerals indicate corresponding parts throughout.

DESCRIPTION OF THE PREFERRED EMBODIMENT

Figure 1:
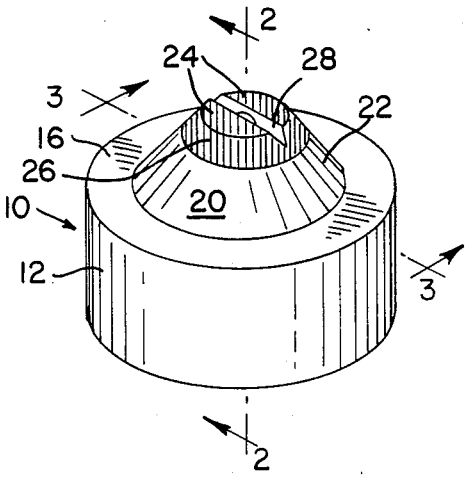
FIG. 1 is a perspective view of a spray nozzle which incorporates therein the principal features of the invention.

Referring now to the drawings, there is shown a spray nozzle generally designated 10, which is adapted to be used in connection with a spray gun. As shown and described in U.S. Pat. No. 4,256,260, s spray nozzle is positioned within a spray head for use in conjunction with an airless spray gun, a supply conduit or other source of supply for a liquid product which is to be applied to an object to be treated with the liquid product.

Figure 2:
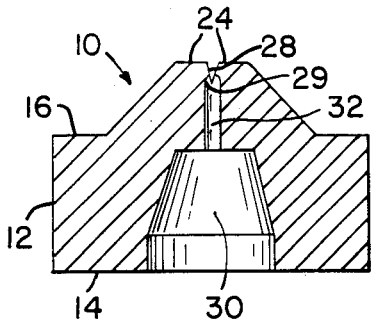
FIG. 2 is a sectional view of the spray nozzle of the present invention taken on line 2—2 of FIG. 1.
Figure 3:
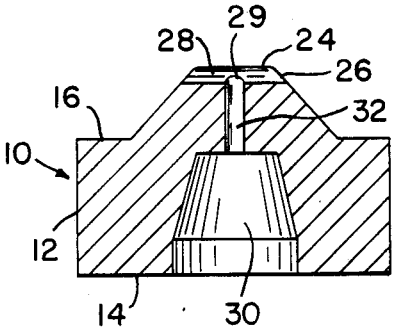
FIG. 3 is a sectional view of the spray nozzle of the present invention taken on the line 3—3 of FIG. 1.
Figure 4:
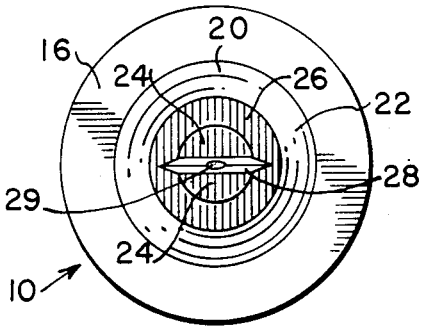
FIG. 4 is a top view of the spray nozzle of the present invention.

As shown in FIGS. 1–4, the spray nozzle 10 has a circumferentially extending outer wall 12, a bottom wall 14, and a top wall 16. The exposed surface of the top wall 16 forms an annular ring. The top wall 16 also includes a nose 20 situated within the annular ring of the top wall 16.

The nose 20 has a generally circular base, and has a generally inwardly inclined sidewall portion 22 terminating in a generally circular end face or top portion 24. The sidewall portion 22 has a margin portion 26 at the edge of the sidewall portion 22 adjacent to the top portion 24. The top portion 24 is generally flat and has a beveled groove 28 cut therein along the center line. An outlet or orifice 29 is positioned in the center of a transversely extending groove 28 to permit the passage of a liquid product through the spray nozzle 10. The configuration of the groove 28 and the orifice 29 will determine the spray pattern which the nozzle 10 will emit.

The spray nozzle 10 has an inlet opening in bottom wall 14 leading to an axial bore 30 and a bore 32 of reduced cross section to establish fluid communication between the spray gun and the nozzle 10. The liquid product emanating from the spray gun will pass through the bores 30, 32 and exit through the orifice 29 in a predetermined spray pattern onto the object to be sprayed.

The spray nozzle 10 is typically made of metal, such as tungsten carbide, and is either machined, pressed and sintered, or cast such that the finished surface of nozzle 10 is somewhat rough or irregular. When the external surface of the nozzle 10 is magnified sufficiently, the asperity of the metal surface is clearly apparent.

During the use of the nozzle 10 in a spray gun, the liquid product which passes through the bores 30, 32 and orifice 29, will form very fine droplets of the material sprayed, which droplets will remain in the atmosphere surrounding the spraying operation. Due to the high velocity of the sprayed material, the droplets will be pulled across the top and margin portions 24, 26 of the nozzle 10. Additional droplets of material will also be present in the atmosphere surrounding the spraying operation, due to spraying at very close ranges, or by increasing the pressure at which the spraying operation is conducted.

The surface tension of the droplets in the atmosphere surrounding the top and margin portions 24, 26 of the nozzle 10 is such that the surface layers of droplets will mechanically interlock with the asperities on such surface portions 24, 26 thereby resulting in an undesired collection and resultant drying of residue on the nozzle 10. The collection of such residue on the portions 24, 26 of the nozzle 10 will continue to build up and eventually adversely affect the spray pattern having exited the orifice 29, thereby severely hampering the performance of the nozzle 10.

In order to substantially prevent the collection and resultant buildup of material on the nozzle 10, particularly portions 24, 26, it has been determined that the such portions 24, 26 should be highly polished until they exhibit a mirror-like finish. This mirror-like finish is commonly referred to as a micro-finish. The polishing of portions 24, 26 results in a surface finish which is relatively smooth and free of asperities. The removal of the asperities from this surface of the nozzle 10, will substantially reduce or prevent the mechanical interlocking of the surface layers of the droplets with the exterior surface of portions 24, 26. This will result in the reduction or elimination of the build up of residue on the exterior surface of the nozzle top and margine portions 24, 26.

The surface finish of any metal object such as the nozzle 10 of the instant invention is commonly measured in micro-inches (RMS). By RMS is meant root mean square or the average smoothness of the surface measured.

Through experimentation and testing, it has been determined that by polishing the portions 24, 26 to three (3) micro-inches (RMS) or less, optimum performance of the nozzle is attained. When polished to 3 micro-inch finish or less, the nozzle 10, by its inherent properties, will reduce or substantially eliminate the collection of residue material on the polished areas.

During the use of the polished spray nozzle 10 of this invention, the fine droplets formed from liquid product exiting the orifice 29 will not adhere to the polished area of the spray nozzle 10. This will result in preventing, not only, the build-up of material on the portions 24, 26, but also, the resultant effect on the spray distribution or spray pattern having exited the orifice 29. Thus, the nozzle will be able to operate at optimum performance, and not require frequent cleaning, nor result in significant downtime of the spray gun and nozzle assembly.

In the event that any material collects on the portions 24, 26, it is very likely that such material will be pulled off the portions 24, 26 by the subsequent spray exiting the orifice 29. This result will most probably be attained because the highly polished micro-finished surface has no major imperfections or surface roughness to which the material collecting can securely cling.

It is generally known to those skilled in the art that the configuration of the nose 20 and of the spray nozzle 10 can be altered without affecting the performance of the nozzle 10, as long as portions 24, 26 have a relatively continuous smooth surface. For the nose 20 could be a spherical shape, rather than the generally flat sidewall portion 22 and generally flat top portion 24, as disclosed on FIGS. 1–4.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A spray nozzle tip assembly for spraying a fluid material from a spray gun onto an object, said nozzle tip being adapted to be received within a spray gun, comprising, a generally cylindrical body having a portion adapted to be received in position of use with respect to an associated spray gun, said nozzle tip body having an inlet end and outlet end and including an axial bore extending from said inlet end and terminating prior to said outlet end, said inlet end of said nozzle body being positioned in the gun to establish a fluid communication between said nozzle tip body and the spray gun; said nozzle tip body further including a nose portion which is generally tapered toward and terminates in an end face, said end face being located at said outlet end; said end face also having a transverse groove cut therein; said groove intersects said axial bore to form an outlet opening or orifice through which the fluid material from the spray gun will exit to contact the object to be sprayed; said orifice being recessed from said end face; said nose portion including margin portions lying adjacent to and radially outwardly of said end face; said margin portions and said end face defining an external surface finish portion of said nozzle tip; and said external surface portion of said nozzle tip being highly polished to a non-adherent generally smooth surface of not more than a three micro-inch (RMS) surface roughness, said smooth surface being operative to substantially reduce or prevent the collection and resultant drying and build up of fluid material on said nozzle tip surface.

2. A spray nozzle tip according to claim 1 wherein said portion of said nozzle tip body adapted to be received in the spray gun includes a generally circumferentially extending wall, said wall being generally parallel to said axial bore.

3. A spray nozzle tip assembly according to claim 1 wherein said portion of said nozzle tip body adapted to be received in the spray gun further includes a substantially flat wall being located at said inlet end of said axial bore and adapted to be seated in the interior of the spray gun.

4. A spray nozzle tip assembly according to claim 1 wherein said axial bore includes a second axial bore of greater cross section than said axial bore and said second axial bore extends from said inlet end and terminates prior to said orifice opening.

5. A spray nozzle tip assembly according to claim 1 wherein said axial bore includes a plurality of axial bores of decreasing cross section as the bore extends from said inlet to said orifice.

6. A spray nozzle tip assembly according to claim 1 wherein said transverse groove and said orifice are of a pre-determined configuration to permit the fluid flowing therefrom to exit and form a specific spray pattern.

* * * * *